US007029816B2

(12) United States Patent
Sasaki et al.

(10) Patent No.: US 7,029,816 B2
(45) Date of Patent: Apr. 18, 2006

(54) ELECTROGRAPHIC IMAGE FORMATION METHOD

(75) Inventors: Fumihiro Sasaki, Shizuoka (JP); Mitsuo Aoki, Shizuoka (JP); Yasuaki Iwamoto, Shizuoka (JP); Naohito Shimota, Shizuoka (JP); Kazuyuki Yazaki, Shizuoka (JP); Hiroaki Matsuda, Shizuoka (JP); Hiroshi Nakai, Kanagawa (JP); Kumi Hasegawa, Shizuoka (JP); Shinichiro Yagi, Shizuoka (JP); Hiroto Higuchi, Shizuoka (JP); Akemi Sugiyama, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/871,009

(22) Filed: Jun. 21, 2004

(65) Prior Publication Data

US 2004/0224247 A1 Nov. 11, 2004

Related U.S. Application Data

(63) Continuation of application No. 09/905,872, filed on Jul. 17, 2001, now abandoned.

(30) Foreign Application Priority Data

Jul. 17, 2000 (JP) ..... 2000-216526

(51) Int. Cl.
*G03G 15/16* (2006.01)

(52) U.S. Cl. ..... 430/126; 430/66; 430/58.2

(58) Field of Classification Search ..... 430/126, 430/110.3, 66, 67, 59.6, 58.05, 58.2
See application file for complete search history.

(56) References Cited

U.S. PATENT DOCUMENTS

| | | | | |
|---|---|---|---|---|
| 2,297,691 | A | 10/1942 | Carlson | |
| 4,766,048 | A * | 8/1988 | Hisamura | 430/66 |
| 5,942,360 | A | 8/1999 | Janezic et al. | |
| 6,030,736 | A * | 2/2000 | Ikegami et al. | 430/59.6 |
| 6,060,205 | A | 5/2000 | Takeichi et al. | |
| 6,077,635 | A | 6/2000 | Okado et al. | |
| 6,403,275 | B1 | 6/2002 | Kuramoto et al. | |
| 6,468,706 | B1 | 10/2002 | Matsuda et al. | |
| 6,544,704 | B1 | 4/2003 | Matsuda et al. | |
| 6,562,529 | B1 * | 5/2003 | Kojima et al. | 430/66 |
| 2001/0033983 | A1 * | 10/2001 | Ohno et al. | 430/110.3 |

FOREIGN PATENT DOCUMENTS

| | | |
|---|---|---|
| JP | 5-165244 | 7/1993 |
| JP | 2000352832 A * | 12/2000 |

OTHER PUBLICATIONS

Diamond, Arthur S. (editor) Handbook of Imaging Materials. New York: Marcel-Dekker, Inc. (1991) pp. 160-163.*
Arthur S. Diamond (editor) Handbook of Imaging Materials. New York; Marcel-Dekker, In.c (1991). pp. 160-163.

* cited by examiner

*Primary Examiner*—Christopher Rodee
(74) *Attorney, Agent, or Firm*—Oblon, Spivak, McClelland, Maier & Neustadt, P.C.

(57) ABSTRACT

An image formation method includes the steps of charging the surface of an electrophotographic photoconductor, exposing the charged photoconductor to a light image to form a latent electrostatic image on the photoconductor, developing the latent electrostatic image using a two-component developer containing a toner and a carrier to obtain a toner image, and transferring the toner image to an image receiving material directly or via an intermediate transfer member, with the photoconductor showing a surface friction coefficient of 0.40 or less, and the toner having toner particles with an average circularity of 0.930 or more.

3 Claims, 1 Drawing Sheet

FIGURE
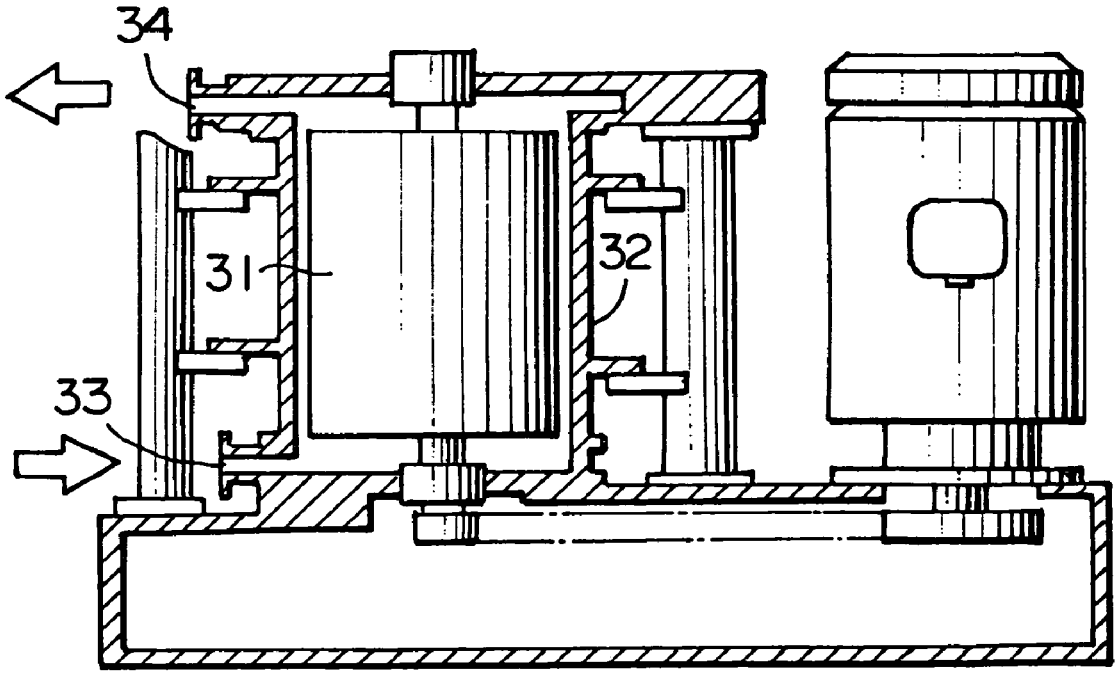

ELECTROGRAPHIC IMAGE FORMATION METHOD

BACKGROUND OF THE INVENTION

1. Field of the Invention

The present invention relates to an image formation method using an electrophotographic photoconductor and a two-component developer in combination.

2. Discussion of Background

According to the electrophotographic process, a latent electrostatic image is formed on the surface of a photoconductor through the steps of charging and light exposure, and the formed latent electrostatic image is developed with a developer to obtain a toner image. The toner image thus formed is transferred to an image receiving material and fixed thereon, whereby a visible toner image can be obtained on the image receiving material. To develop the latent electrostatic image, there are conventionally employed a powder cloud development method, a cascade development method, a magnetic-brush development method, and so on. In particular, the magnetic-brush method is widely employed.

A two-component dry developer for use with the magnetic-brush development method is composed of a magnetic carrier component, for example, comprising ferrite particles, and a toner component, for example, comprising toner particles containing a coloring agent and a resin. The carrier particles and toner particles are triboelectrically charged and retained under such conditions. When the two-component developer comes in close vicinity to the latent electrostatic image formed on the photoconductor, the toner particles for use in the two-component developer are separate from the carrier and drawn toward the latent electrostatic image if the force of an electric field for constituting the latent electrostatic image overcomes the triboelectric attraction of the toner particles for the carrier particles. In this case, the toner particles are attracted and attached to the latent electrostatic image, whereby the latent electrostatic image on the photoconductor is made visible. The toner component for use in the developer is thus consumed in the course of development, and the two-component developer is repeatedly and continuously used with the toner component being replenished in the developer.

Such an electrophotographic process is carried out in the conventional copying machines. In addition to the copying machines, laser beam printers adopting the electrophotographic process have been currently on the market to output the data with the recent spread of computers. In line with such a tendency, the electrophotographic image forming apparatus is required to produce high quality images. From the viewpoint of the employed developer, high quality images can be obtained by decreasing the particle diameters of both the toner particles and the carrier particles. In particular, a decrease in particle diameter of the toner particles is considered to be effective in faithfully reproducing a fine latent image on the photoconductor.

However, the smaller the particle diameter of the toner particles, the more the triboelectric charging characteristics of the toner particles themselves. Further, the adhesion between the toner particles determined by the van der Waals force is increased. As a result, there is a possibility that a toner image portion with a large toner deposition amount formed on the photoconductor cannot be completely transferred to a transfer sheet such as a sheet of paper. In other words, non-transferred spots may appear in the form of worm-eaten spots.

To solve the above-mentioned problem, some proposals are made with special attention being paid to the surface properties of the photoconductor on which toner images are to be formed. For example, Japanese Laid-Open Patent Application 5-188643 discloses a toner that is produced by polymerization so as to be composed of toner particles classified in a narrow particle size distribution. However, the particle size of the toner particles obtained by the method disclosed in this application is still insufficient when the carrier with a smaller particle diameter is used in combination. Further, by the above-mentioned preparation method, the toner needs a coating film in which inorganic particles are dispersed, so that there is some difficulty in preparing the toner particles.

In light of the above-mentioned prior art, there is an increasing demand for establishment of an electrophotographic image formation method capable of more conveniently producing high quality images.

SUMMARY OF THE INVENTION

Accordingly, an object of the present invention is to provide an electrophotographic image formation method capable of producing toner images with high precision without defective transfer to an image receiving material even though the particle diameter of the employed toner particles is decreased.

The above-mentioned object of the present invention can be achieved by an electrophotographic image formation method comprising the steps of charging the surface of an electrophotographic photoconductor, exposing the charged photoconductor to a light image to form a latent electrostatic image on the photoconductor, developing the latent electrostatic image using a two-component developer comprising a toner and a carrier to obtain a toner image, and transferring the toner image to an image receiving material directly or via an intermediate transfer member, wherein the photoconductor has a surface friction coefficient of 0.40 or less, and the toner comprises toner particles with an average circularity of 0.930 or more.

BRIEF DESCRIPTION OF THE DRAWING

A more complete appreciation of the invention and many of the attendant advantages thereof will be readily obtained as the same becomes better understood by reference to the following detailed description when considered in connection with the accompanying drawing, wherein:

a single FIGURE is a schematic cross sectional view showing one embodiment of a mechanical crusher for preparing a toner for use in the present invention.

DESCRIPTION OF THE PREFERRED EMBODIMENTS

The inventors of the present invention have found that excellent toner images with high preciseness can be obtained with minimum defective image transfer to an image receiving material when the friction coefficient of the surface portion of the employed photoconductor is specified, for example, by adding a silicone oil to a surface portion of the photoconductor, and the shape factor of the employed toner are also specified.

Namely, when the average circularity of the toner particles is controlled to 0.930 or more, preferably 0.940 or more, the toner particles are provided with an appropriate spherical form. The toner particles prepared into such a spherical form can improve the fluidity of toner. Further, those toner particles can be transferred to an image receiving material satisfactorily when used in combination with the photoconductor with a small friction coefficient.

For example, a toner image formed on the photoconductor is transferred to an image receiving material such as a sheet of paper, with the image receiving material being urged toward the photoconductor by a transfer member. In this case, the toner image formed on the photoconductor is compressed under the application thereto of a pressure by the transfer member. There is a risk that the compressed portion in the toner image may not be transferred to the image receiving material. Such defective transfer, i.e., occurrence of non-image transferred spots can be prevented by using the combination of the toner and the photoconductor specified in the present invention.

The present invention will now be explained in detail.

The two-component developer for use in the present invention comprises a toner and a carrier. The toners prepared by any conventional methods can be adopted in the present invention. To be more specific, a mixture of a binder resin, a coloring agent, and a charge control agent is melted and kneaded, and the kneaded mixture is cooled. A solid lump of the cooled mixture is subjected to pulverizing and classification, so that toner particles can be prepared.

Specific examples of the binder resin for use in the toner of the present invention are as follows:

homopolymers of styrene and substituted styrenes, such as polystyrene, poly(p-chlorostyrene), and poly(vinyl-toluene); styrene copolymers such as styrene—p-chlorostyrene copolymer, styrene—propylene copolymer, styrene—vinyltoluene copolymer,styrene—vinylnaphthalene copolymer,styrene—acrylate copolymer, styrene—methacrylate copolymer,styrene—acrylonitrile copolymer,styrene—vinyl methyl ether copolymer, styrene—vinyl ethyl ether copolymer,styrene—vinyl methyl ketone copolymer,styrene—butadiene copolymer, styrene—isoprene copolymer, andstyrene—acrylonitrile—indene copolymer; and other resins such as acrylic resin, methacrylic resin, poly(vinyl chloride), poly(vinyl acetate), polyethylene, polypropylene, polyester resin, poly(vinyl butyral), polyacrylic acid resin, rosin, modified rosin, terpene resin, phenolic resin, natural-resin-modified phonolic resin, natural-resin-modified maleic resin, polyurethane, polyamide resin, furan resin, epoxy resin, coumarone-indene resin, silicone resin, aliphatic or alicyclic hydrocarbon resin, and aromatic petroleum resin. Those resins can be employed alone or in combination.

Of the above-mentioned resins, styrene copolymers and polyester resin are preferably used as the binder resins for use in the toner when the developing properties and image fixing performance of the obtained toner are taken into consideration.

To prepare the styrene copolymers, a styrene monomer and the following comonomers can be used: double-bond containing monocarboxylic acids and substituted compounds thereof, such as acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile, and acrylamide; double-bond containing dicarboxylic acids and substituted compounds thereof, such as maleic acid, butyl maleate, methyl maleate, and dimethyl maleate; vinyl esters such as vinyl chloride, vinyl acetate, and vinyl benzoate; olefins such as ethylene, propylene, and butylene; vinyl ketones such as vinyl methyl ketone and vinyl hexyl ketone; and vinyl ethers such as vinyl methyl ether, vinyl ethyl ether, and vinyl isobutyl ether. Those vinyl monomers can be employed alone or in combination.

The polyester resin preferably serving as a binder resin for use in the toner can be synthesized by the conventional method using an alcohol component and an acid component.

Examples of the alcohol component for synthesizing the polyester include diols such as polyethylene glycol, diethylene glycol, triethylene glycol, 1,2-propylene glycol, 1,3-propylene glycol, 1,4-propylene glycol, neopentyl glycol, and 1,4-butene diol; etherified bisphenols and dihydric alcohol monomers prepared by substituting the above-mentioned bisphenols with a saturated or unsaturated hydrocarbon group having 3 to 22 carbon atoms, and other dihydric alcohol monomers, such as 1,4-bis(hydroxymethyl)cyclohexane, bisphenol A, hydrogenated bisphenol A, reaction product of polyoxyethylene and bisphenol A, and reaction product of polyoxypropylene and bisphenol A; and polyhydric alcohol monomers having three or more hydroxyl groups, such as sorbitol, 1,2,3,6-hexanetetrol, 1,4-sorbitan, pentaerythritol, dipentaerythritol, tripentaerythritol, sucrose, 1,2,4-butanetriol, 1,2,5-pentatriol, glycerol, 2-methylpropanetriol, 2-methyl-1,2,4-butanetriol, trimethylolethane, trimethylolpropane, and 1,3,5-trihydroxymethylbenzene.

Examples of the acid component for synthesizing the polyester include monocarboxylic acids such as palmitic acid, stearic acid, and oleic acid; organic dicarboxylic acid monomers which may have as a substituent a saturated or unsaturated hydrocarbon group having 3 to 22 carbon atoms, such as maleic acid, fumaric acid, mesaconic acid, citraconic acid, itaconic acid, glutaconic acid, phthalic acid, isophthalic acid, terephthalic acid, cyclohexane-dicarboxylic acid, succinic acid, adipic acid, sebacic acid, and malonic acid, anhydrides of the above dicarboxylic acid monomers, dimers of lower alkyl ester and linolenic acid, and other organic dicarboxylic acid monomers; and polycarboxylic acid monomers with three or more carboxyl groups, such as 1,2,4-benzenetricarboxylic acid, 1,2,5-benzenetricarboxylic acid, 1,2,4-cyclohexane-tricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, and tetra(methylenecarboxyl)methane, and 1,2,7,8-octanetetracarboxylic acid, and anhydrides of the above carboxylic acids with three or more carboxyl groups.

As the coloring agent for use in the toner of the present invention, any coloring agents for the conventional toner compositions can be employed.

Examples of the black coloring agent are carbon black, oil furnace black, channel black, lamp black, acetylene black, azine dyes such as aniline black, metallic salt azo dyes, metallic oxides, and composite metallic oxides.

Phthalocyanine Blue, Methylene Blue, Victoria Blue, Methyl Violet, Aniline Blue, and ultramarine blue can be used as cyan coloring agents; Rhodamine 6G Lake, dimethyl quinacridone, Watchung Red, Rose Bengale, Rhodamine B, and alizarin lake, as magenta coloring agents; and chrome yellow, Benzidine Yellow, Hansa Yellow, Naphthol Yellow, molybdenum orange, Quinoline Yellow, and Tartrazine, as yellow coloring agents.

To charge the toner more effectively, a small amount of charge-imparting agent, e.g., a dye or pigment and a charge control agent may be added to the toner composition.

Specific examples of the charge control agent include metal complex salts of monoazo dye, nitrohumic acid and salts thereof, metal (Co, Cr, Fe or the like) complexes of salicylic acid, naphthoic acid, and dicarboxylic acid, organic dyes, and quaternary ammonium salts.

The toner may further comprise the conventionally known additives when necessary. Namely, a fluidity imparting agent such as colloidal silica; abrasives, e.g., metallic oxides such as titanium oxide and aluminum oxide, and silicon carbide; and a lubricant such as fatty acid metallic salts may also be added as the additives to the toner composition.

For instance, the previously mentioned binder resin, pigment or dye serving as a coloring agent, charge control agent, and other additives such as a lubricant are sufficiently mixed in a mixer such as a Henschel mixer. Thereafter, the mixture is thoroughly kneaded using a batch-type two-roll mixer, Banburry's mixer, a continuous double screw extruder. For example, there can be employed a KTK type double screw extruder made by Kobe Steel, Ltd., a TEM type double screw extruder made by Toshiba Machine Co., Ltd., a double screw extruder made by KCK Co., Ltd., a PCM type double screw extruder made by Ikegai Tekko Co., Ltd., a KEX type double screw extruder made by Kurimoto, Ltd., and a continuous single screw kneader, for example, "Buss-Ko-Kneader" available from Buss Co., Ltd.

After the thus kneaded mixture is cooled, the mixture is coarsely crushed by a hammer mill or the like. For the preparation of a color toner, a master batch may be prepared in advance by mixing and kneading a pigment and part of the employed binder resin under application of heat thereto for improving the dispersibility of the pigment in the obtained toner composition.

The coarse particles are then finely pulverized by means of a fine grinding mill using a jet air stream and/or a mechanical crusher. In the present invention, the mechanical crusher is preferably used to finely pulverize the particles so that the specific shape index can be obtained. The finely pulverized particles thus prepared are classified to obtain a predetermined particle size by an air classifier using a vortex or a classifier utilizing the Coanda effect.

Then, the classified particles are sufficiently mixed with the fluidity-imparting agent in a mixer such as a Henschel mixer, and the obtained particles are caused to pass through a screen with 250-mesh or more to remove the coarse particles and the aggregated particles. Thus, a toner for use in the present invention can be obtained.

The pulverizing means for obtaining the toner particles will now be explained in detail with reference to the single FIGURE.

The FIGURE is a schematic cross sectional view showing one embodiment of the mechanical crusher for producing the toner for use in the present invention.

A crusher shown in the FIGURE comprises a rotor 31 and a liner 32. The rotor 31 is an inner cylinder designed to be freely rotatable, with the outer surface of the cylindrical wall having numerous grooves extending in a direction of the rotating shaft. On the other hand, a liner 32, that is an external cylinder, is also provided with numerous grooves on the inner surface of the cylindrical wall, each groove extending in the direction of the rotating shaft.

When the rotor 31 is driven to rotate at high speed, the air in a crushing chamber, namely, the gap between the rotor 31 and the liner 32, begins to violently whirl, and a low pressure and a high pressure are alternately generated and periodically changed in the gap. The mixture of the coloring agent, binder resin, charge control agent, and the like is drawn into the crushing chamber together with air through a supply opening 33. The supply opening 33 is also regarded as a suction port. In the crushing chamber, large particles are subjected to volume grinding as hitting against the walls of the rotor 31 and the liner 32 by the application of an impact using the violently whirling air generated between the rotor 31 and the liner 32. The crushed particles undergo surface grinding, and at the same time, the charge control agent is deposited on the surface of the crushed particles. The thus obtained particles are discharged from the crushing chamber through a discharge opening 34 together with air. The surface grinding enables the surface portion of each particle to be peeled off and the charge control agent to be deposited on the stripped portion of each particle instead. In other words, rearrangement can be carried out at the surface portion of the particles by surface grinding. The surface grinding is particularly effective when toner particles are produced by the wet method. This is because impurities such as a surfactant deposited on the surface of the toner particles in the course of production can be removed by the surface grinding.

The protruding tip on the inner wall of the liner is designed to face the protruding portion on the outer wall of the rotor with a minimum distance of 0.2 to 10 mm, preferably 0.3 to 5 mm. As the commercially available mechanical crushers that can meet the above-mentioned conditions, there are rotor-type crushers "Turbo Mill" (Trademark), made by Turbo Kogyo Co., Ltd.; "Kryptron" (Trademark), made by Kawasaki Heavy Industries, Ltd.; and "Fine Mill" (Trademark), made by Nippon Pneumatic Mfg. Co., Ltd.

The circularity of the toner particles can be controlled by passing the toner particles through the crushing and classification steps a plurality of times in a closed-circuit. To be more specific, toner particles crushed by the above-mentioned mechanical crusher are fed to a classifier to separate coarse particles of which particle diameters are twice or more the average particle diameter. The coarse particles thus separated are again returned to the mechanical crusher for crushing.

The toner may be used in combination with a magnetic carrier. Any magnetic carrier conventionally known in this field can be used. For example, a magnetic powder such as an iron powder, ferrite powder, nickel powder, magnetite powder, or the like are employed. Further, those magnetic powders may be surface-treated with a resin, or resin particles in which the above-mentioned magnetic particles are dispersed may be used.

When the magnetic powder is coated with a resin as mentioned above, the following resins can be used: polyolefin resins such as polyethylene, polypropylene, chlorinated polyethylene, and chlorosulfonated polyethylene; polyvinyl resins and polyvinylidene resins such as polystyrene, acrylic resin, e.g., poly(methyl methacrylate), polyacrylonitrile, poly(vinyl acetate), poly(vinyl alcohol), poly (vinyl butyral), poly(vinyl chloride), poly(vinylcarbazole), poly(vinyl ether), poly(vinyl ketone), and vinyl chloride—vinyl acetate copolymer; fluorine-containing resins such as polytetra-fluoroethylene, poly(vinyl fluoride), poly(vinylidene fluoride), and polychlorotrifluoroethylene; polyamide; polyester; polyurethane; polycarbonate; amino resin such as urea-formaldehyde resin; epoxy resin; and silicone resin.

As the above-mentioned silicone resin serving as a coating film for the carrier particles, any conventional silicone resins, for instance, a straight silicone resin consisting of organosiloxane bond, as indicated by the following formula, and alkyd-, polyester-, epoxy-, and urethane-modified silicone resins are known.

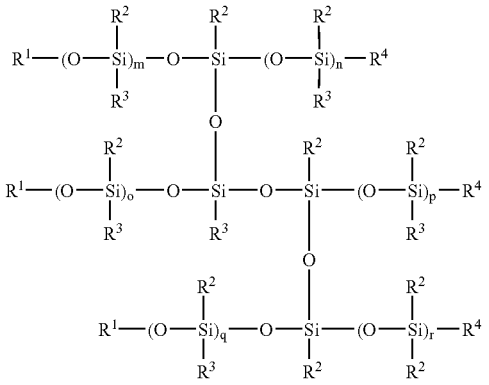

wherein m, n, o, p, q, and r are each an integer of 1 or more; $R^1$ is a hydrogen atom, an alkyl group having 1 to 4 carbon atoms, or phenyl group; $R^2$ and $R^3$ are each a hydrogen atom, an alkoxyl group having 1 to 4 carbon atoms, phenyl group, phenoxy group, an alkenyl group having 2 to 4 carbon atoms, an alkenyloxy group having 2 to 4 carbon atoms, hydroxyl group, carboxyl group, ethylene oxide group, glycidyl group, or a group represented by the following formula:

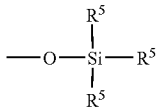

in which $R^4$ and $R^5$ are each hydroxyl group, carboxyl group, an alkyl group having 1 to 4 carbon atoms, an alkoxyl group having 1 to 4 carbon atoms, an alkenyl group having 2 to 4 carbon atoms, an alkenyloxy group having 2 to 4 carbon atoms, phenyl group, or phenoxy group.

The above-mentioned groups represented by $R^4$ and $R^5$ may have a substituent such as an amino group, hydroxyl group, carboxyl group, mercapto group, alkyl group, phenyl group, ethylene oxide group, glycidyl group, or halogen atom.

The coating film covering each of the carrier particles may comprise carbon black to obtain a desired electric resistivity of the employed carrier. In such a case, any carbon black, e.g., furnace black, acetylene black, and channel black can be used. In particular, a mixture of furnace black and acetylene black makes it possible to effectively control the electroconductivity of the carrier even by the addition of a small amount, and to provide the coating film with high wear resistance. It is preferable that the carbon black added to the coating film for use in the carrier particles have a particle diameter of about 0.01 to about 10 μm. Further, it is desirable that the amount of carbon black be in the range of 2 to 30 parts by weight, and more preferably 5 to 20 parts by weigh, with respect to 100 parts by weight of the resin used to constitute the coating film.

The coating film for use in the carrier particles may further comprise a silane coupling agent or titanium coupling agent for the purpose of improving the adhesion of the coating film to the core particle for use in the carrier particle and increasing the dispersion properties of the electroconductivity imparting agent.

The silane coupling agent represented by formula of (YRSiX) is preferably employed. In the aforementioned formula, X is a hydrolyzable group bonded to silicon atom (Si), such as chloro group, alkoxyl group, acetoxy group, alkylamino group, or propenoxy group; Y is an organic functional group reactive to an organic matrix, such as vinyl group, methacryl group, epoxy group, glycidoxy group, amino group, or mercapto group; and R is an alkyl group or alkylene group having 1 to 20 carbon atoms.

With respect to the silane coupling agent, an amino silane coupling agent in which Y represents amino group and an epoxy silane coupling agent in which Y represents epoxy group are respectively advantageous to obtain a negatively chargeable toner and a positively chargeable toner.

The surface of the carrier core particles may be coated with a liquid for formation of the coating film by spray coating method or dip coating method. The thickness of the coating film may be in the range of 0.1 to 20 μm.

The electrophotographic photoconductor for use in the present invention will now be explained in detail.

In the present invention, a photoconductor comprising an electroconductive support and a photoconductive layer formed thereon can be employed. In particular, the photoconductive layer employing an organic photoconductive material is preferably used because of its advantages of low cost, high productivity, and no cause of the environmental pollution. A function-separating photoconductor comprising a charge generation material and a charge transport material is most preferably used in light of the performance of the obtained photoconductor.

For the preparation of a drum-shaped electro-conductive support, a metal layer of Al, Ag, or Au or a metallic oxide layer of $In_2O_3$ or $SnO_2$ may be provided on an electrically insulating support member made of a metal such as Al, Ni, Fe, Cu or Au, or an alloy thereof, a plastic material such as polycarbonate or polyimide, or glass.

When the function-separating photoconductor is fabricated, a charge generation layer and a charge transport layer are successively overlaid on the electroconductive support. The charge generation layer may consist of a charge generation material or comprise a binder resin and a charge generation material uniformly dispersed in the binder resin. Those components are dispersed in an appropriate solvent to prepare a coating liquid for the charge generation layer, and the coating liquid thus prepared may be coated on the electro-conductive support and dried, whereby a charge generation layer can be provided.

Specific examples of the charge generation material for use in the present invention are as follows: organic pigments, for example, azo pigments, such as C.I. Pigment Blue 25 (C.I. 21180), C.I. Acid Red 52 (C.I. 45100), C.I. Basic Red 3 (C.I. 45210), an azo pigment having a carbazole skeleton (Japanese Laid-Open Patent Application 53-95033), an azo pigment having a stilbene skeleton (Japanese Laid-Open Patent Application 53-138229), an azo pigment having a distyryl benzene skeleton (Japanese Laid-Open Patent Application 53-133455), an azo pigment having a triphenylamine skeleton (Japanese Laid-Open Patent Application 53-132547), an azo pigment having a dibenzothiophene skeleton (Japanese Laid-Open Patent Application 54-21728), an azo pigment having an oxadiazole skeleton (Japanese Laid-Open Patent Application 54-12742), an azo pigment having a fluorenone skeleton (Japanese Laid-Open Patent Application 54-22834), an azo pigment having a bisstilbene skeleton (Japanese Laid-Open Patent Application 54-17733), an azo pigment having a distyryl oxadiazole skeleton (Japanese Laid-Open Patent Application 54-2129), an azo pigment having a distyryl carbazole skeleton (Japanese Laid-Open Patent Application 54-17734), and a trisazo pigment having a carbazole skeleton (Japanese Laid-Open Patent Applications 57-195767 and 57-195758); phthalocyanine pigments having a porphyrin skeleton, such as C.I. Pigment Blue 16 (C.I. 74100); indigo pigments such as C.I. Vat Brown 5 (C.I. 73410); perylene pigments such as Algol Scarlet B and Indanthrene Scarlet R (made by Bayer Co., Ltd.); and squaric pigments. In addition, inorganic pigments such as Se and Se alloys and amorphous silicon can also be used.

Specific examples of the binder resin for use in the charge generation layer are polyamide, polyurethane, polyester, epoxy resin, polyketone, polycarbonate, silicone resin, acrylic resin, poly(vinyl butyral), poly(vinyl formal), poly (vinyl ketone), polystyrene, poly-N-vinylcarbazole, and polyacrylamide.

It is preferable that the amount of binder resin be in the range of 5 to 100 parts by weight, and more preferably 10 to 50 parts by weight, with respect to 100 parts by weight of the charge generation material.

Examples of the solvent used to prepare a coating liquid for charge generation layer include tetrahydrofuran, cyclohexanone, dioxane, dichloroethane, cyclohexane, methyl ethyl ketone, 1,1,2-trichloroethane, 1,1,2,2-tetrachloroethane, dichloromethane, and ethyl cellosolve. Those solvents may be used alone or in combination as a mixed solvent.

It is preferable that the charge generation layer have an average thickness of 0.01 to 2 μm, and more preferably 0.1 to 1 μm.

To provide the charge transport layer, a charge transport material and a binder resin are dissolved in a proper solvent, optionally with the addition thereto of a plasticizer and a leveling agent, and a solution containing the charge transport material thus prepared may be coated on the charge generation layer and dried.

Examples of the charge transport material for use in the present invention include electron donating compounds such as poly-N-vinylcarbazole and derivatives thereof, poly-γ-carbazolylethyl glutamate and derivatives thereof, pyrene-formaldehyde condensation product and derivatives thereof, polyvinyl pyrene, polyvinyl phenanthrene, oxazole derivatives, imidazole derivatives, triphenylamine derivatives, 9-(p-diethylamino-styryl)anthracene, 1,1-bis(4-dibenzylaminophenyl)propane, styrylanthracene, styrylpyrazoline, phenylhydrazone compounds, and α-stilbene derivatives.

Examples of the binder resin for use in the charge transport layer include thermoplastic or thermosetting resins such as polystyrene,styrene—acrylonitrile copolymer,styrene—butadiene copolymer, styrene—maleic anhydride copolymer, polyester, poly(vinyl chloride), vinyl chloride—vinyl acetate copolymer, poly(vinyl acetate), poly(vinylidene chloride), polyacrylate resin, phenoxy resin, polycarbonate, cellulose acetate resin, ethyl cellulose resin, poly (vinyl butyral), poly(vinyl formal), poly(vinyl toluene), poly-N-vinylcarbazole, acrylic resin, silicone resin, epoxy resin, melamine resin, urethane resin, phenolic resin, and alkyd resin.

As the solvent for the preparation of a coating liquid for the charge transport layer, tetrahydrofuran, dioxane, toluene, monochlorobenzene, 1,2-dichloroethane, cyclohexanone, dichloromethane, and 1,1,2-trichloroethane, 1,1,2,2-tetrachloroethane can be used alone or in combination.

It is preferable that the charge transport layer have a thickness of 10 to 100 μm, and more preferably 20 to 40 μm.

The photoconductor for use in the present invention may further comprise an undercoat layer which is interposed between the electroconductive support and the charge generation layer for improving the adhesion between the electroconductive support and the charge generation layer and enhancing the electric charge blocking properties. Further, the overlaying order of the charge generation layer and the charge transport layer on the electroconductive support may be reversed. Furthermore, a protective layer may be overlaid on the photoconductive layer to improve the wear resistance.

To reduce the coefficient of surface friction of the photoconductor to 0.40 or less, a lubricating resin or resin powder, a surfactant, or the like may be dissolved or dispersed in the surface portion of the photoconductor. In the present invention, addition of a silicone oil to the surface portion of the photoconductor is effective. This is because the surface of the photoconductor can be made smoother by the leveling action of the silicone oil when compared with the case where the resin powder is, dispersed in the surface portion of the photoconductor. As a result, adhesion of the carrier to the surface of the photoconductor can be prevented more effectively.

It is preferable that the silicone oil employed for the surface portion of the photoconductor have a viscosity of 100 cSt or less. Although the silicone oil having a viscosity of more than 100 cSt has the effect of decreasing the friction coefficient, such a viscosity of the silicone oil will consequently increase the adhesion of the surface portion of the photoconductor to some extent.

Any silicone oil generally used can be employed in the present invention. For example, straight silicone oils such as dimethyl silicone oil, methylphenyl silicone oil, and methyl hydrogen silicone oil, and modified silicone oils, e.g., alkyl-, amino-, carboxyl-, higher fatty acid-, epoxy-, alcohol-, polyether-, alkyl.polyether-, and fluorine-modified silicone oils are both preferably employed.

The silicone oil may be added to the surface portion of the photoconductor so as to obtain a desired friction coefficient. It is preferable that the amount of silicone oil to be added to the surface portion be in the range of about 0.01 to 5 wt. % of the total weight of the resin contained in the surface portion.

In the image formation method of the present invention, the step of transferring the toner image is carried out using an image transfer unit. In the image transfer unit, the toner image formed on the surface of the photoconductor may be first transferred to an intermediate transfer member, for example, in the form of a rotatable cylinder or an endless belt that is brought into pressure contact with the photoconductor, and thereafter the toner image may be transferred again from the intermediate transfer member to an image receiving material such as a sheet of paper. Alternatively, the toner image formed on the photoconductor may be transferred to the image receiving material directly with the aid of a transfer member such as a transfer roller or belt. In any case, a bias voltage may be applied to the intermediate transfer member or the transfer member.

Other features of this invention will become apparent in the course of the following description of exemplary embodiments, which are given for illustration of the invention and are not intended to be limiting thereof.

EXAMPLE 1

[Preparation of Toner (a)]

The following components were sufficiently mixed in a Henschel mixer.

| | Parts by Weight |
|---|---|
| Polyester resin | 80 |
| Styrene/methyl acrylate copolymer | 20 |
| Carnauba wax | 5 |
| Carbon black | 8 |
| Metal-containing monoazo dye | 3 |

The resultant mixture was kneaded in a kneader with extruder that was controlled to 180° C. After the kneaded mixture was cooled for setting, the solid lump of the cooled mixture was coarsely crushed by a cutter mill and finely pulverized by means of a mechanical crusher. The finely-divided particles were subjected to multi-division classification in a classifier using the Coanda effect so as to obtain matrix toner particles with an average circularity of 0.943, including particles with a circularity of 0.90 or less with a content ratio of 8.12% by number.

100 parts by weight of the matrix toner particles were mixed with 0.5 parts by weight of hydrophobic silica particles with an average particle diameter of 0.3 μm in a Henschel mixer, whereby a toner (a) was obtained.

<Measurement of Circularity of Toner>

The circularity of the toner particles was measured using a flow particle image analyzer "FPA-1000" (trademark), made by Toa Medical Electronics Co., Ltd.

[Preparation of Carrier and Two-Component Developer]

The following components were dispersed in a homomixer for 30 minutes, so that a coating film formation liquid was prepared.

| | Parts by Weight |
|---|---|
| Silicone resin solution | 100 |
| Carbon black | 4 |
| Toluene | 100 |

Using a fluidized bed coating apparatus, 1000 parts by weight of ferrite particles with a volume mean diameter of 80 μm were coated with the above-mentioned coating film formation liquid, so that a carrier for use in the present invention was prepared.

The toner (a) was mixed with the above-mentioned carrier to prepare a two-component developer (A).

[Fabrication of Photoconductor No. 1]

<Formation of Undercoat Layer>

A mixture of the following components was subjected to ball-milling in a ball mill for 12 hours, thereby preparing a coating liquid for an undercoat layer:

| | Parts by weight |
|---|---|
| Alkyd resin | 15 |
| Melamine resin | 10 |
| Titanium oxide particles | 90 |
| Methyl ethyl ketone | 150 |

The thus prepared coating liquid was coated on the outer surface of an aluminum drum with an outer diameter of 100 mm and a length of 360 mm by dip coating, and dried at 140° C. for 20 minutes. Thus, an undercoat layer with a thickness of 4.5 μm was provided on the aluminum drum.

<Formation of Charge Generation Layer>

A mixture of the following components was subjected to ball-milling in a ball mill for 72 hours, thereby preparing a coating liquid for a charge generation layer:

| | Parts by weight |
|---|---|
| Poly(vinyl butyral) resin | 4 |
| Trisazo pigment | 10 |
| Methyl ethyl ketone | 700 |

The thus obtained coating liquid was coated on the above prepared undercoat layer by dip coating, and dried at 130° C. for 20 minutes, so that a charge generation layer with a thickness of 0.2 μm was provided on the undercoat layer.

<Formation of Charge Transport Layer>

The following components were stirred and dissolved in a stirrer to prepare a solution:

| | Parts by weight |
|---|---|
| Polycarbonate resin | 10 |
| Triphenylamine compound | 7 |
| Tetrahydrofuran | 85 |

With the addition of 6 parts by weight of silicone resin particles (trademark "Tospearl 120" made by Toshiba Silicone Co., Ltd.) serving as a lubricating material to the above prepared solution, the resultant mixture was stirred for one hour to form a dispersion of the silicone resin particles. Thus, a coating liquid for a charge transport layer was obtained.

The coating liquid for the charge transport layer was coated on the charge generation layer by dip coating and dried at 130° C. for 20 minutes, so that a charge transport layer with a thickness of 20 μm was provided on the charge generation layer. Thus, an electrophotographic photoconductor No. 1 was fabricated.

<Measurement of Friction Coefficient>

A surface portion of the charge transport layer was peeled away from the photoconductor No. 1 and attached to an aluminum plate. Then, the friction coefficient was measured using a commercially available automatic friction abrasion analayzer "DFPN-SS" (trademark), made by KYOWA INTERFACE SCIENCE Co., Ltd. The friction coefficient was 0.40.

<Evaluation of Toner Image>

The two-component developer (A) and the photo-conductor No. 1 were set in a commercially available copying machine "imagio 6550" (trademark), made by Ricoh Company, Ltd. Toner images obtained through the steps of development and image transfer were evaluated in terms of the occurrence of non-image transferred spots. The degree of the image transfer performance was visually evaluated on the following five scales:

Scale 5 Non-transferred spots were not observed.

Scale 4 Non-transferred spots were negligible.

Scale 3 Non-transferred spots were slightly observed, but acceptable for practical use.

Scale 2 Non-transferred spots were noticeable and not acceptable for practical use.

Scale 1 Non-transferred spots were considerable to such a degree that images were illegible.

The results are shown in TABLE 1.

COMPARATIVE EXAMPLE 1

The procedure for fabrication of the photoconductor No. 1 in Example 1 was repeated except that the silicone resin particles were not added to the coating liquid for the charge transport layer. Thus, a photoconductor No. 2 was fabricated. In this case, the friction coefficient of the surface portion of the photoconductor No. 2 was 0.54.

Using the above-mentioned photoconductor No. 2 and the two-component developer (A) prepared in Example 1, toner images were evaluated in the same manner as in Example 1.

The results are shown in TABLE 1.

EXAMPLE 2

The procedure for preparation of the toner (a) in Example 1 was repeated except that the crushing conditions for obtaining the matrix toner particles in Example 1 were changed. Thus, a toner (b) was prepared, in which the matrix toner particles had an average circularity of 0.955, and included particles with a circularity of 0.90 or less with a content ratio of 5.14% by number. The toner (b) was mixed with the same carrier as prepared in Example 1 to obtain a two-component developer (B).

Using the photoconductor No. 1 fabricated in Example 1 and the two-component developer (B), toner images were evaluated in the same manner as in Example 1.

The results are shown in TABLE 1.

EXAMPLE 3

The procedure for preparation of the toner (a) in Example 1 was repeated except that the crushing conditions for obtaining the matrix toner particles in Example 1 were changed. Thus, a toner (c) was prepared, in which the matrix toner particles had an average circularity of 0.948, and included particles with a circularity of 0.90 or less with a content ratio of 7.87% by number. The toner (c) was mixed with the same carrier as prepared in Example 1 to obtain a two-component developer (C).

The procedure for fabrication of the photoconductor No. 1 in Example 1 was repeated except that 6 parts by weight of the silicone resin particles for use in the coating liquid for the charge transport layer were replaced by 20 parts by weight of fluorine-containing resin particles "DAIKIN-POLYFLON PTFE Low-Polymer" (trademark) made by Daikin Industries, Ltd. Thus, a photoconductor No. 3 was fabricated. In this case, the friction coefficient of the surface portion of the photoconductor No. 3 was 0.10.

Using the photoconductor No. 3 thus fabricated and the two-component developer (C), toner images were evaluated in the same manner as in Example 1.

The results are shown in TABLE 1.

COMPARATIVE EXAMPLE 2

The procedure for fabrication of the photoconductor No. 1 in Example 1 was repeated except that the amount of the silicone resin particles for use in the coating liquid for the charge transport layer in Example 1 was changed from 6 to 4 parts by weight. Thus, a photoconductor No. 4 was fabricated. In this case, the friction coefficient of the surface portion of the photoconductor No. 4 was 0.46.

Using the photoconductor No. 4 thus fabricated and the two-component developer (B) prepared in Example 2, toner images were evaluated in the same manner as in Example 1.

The results are shown in TABLE 1.

COMPARATIVE EXAMPLE 3

The procedure for preparation of the toner (b) in Example 2 was repeated except that crushing was carried out using an impact type air stream crusher. Thus, a toner (d) was prepared, in which the matrix toner particles had an average circularity of 0.928, and included particles with a circularity of 0.90 or less with a content ratio of 22.53% by number. The toner (d) was mixed with the same carrier as prepared in Example 1 to obtain a two-component developer (D).

Using the photoconductor No. 1 fabricated in Example 1 and the two-component developer (D), toner images were evaluated in the same manner as in Example 1.

The results are shown in TABLE 1.

COMPARATIVE EXAMPLE 4

Using the photoconductor No. 2 fabricated in Comparative Example 1 and the two-component developer (D) prepared in Comparative Example 3, toner images were evaluated in the same manner as in Example 1.

The results are shown in TABLE 1.

EXAMPLE 4

The procedure for fabrication of the photoconductor No. 1 in Example 1 was repeated except that 6 parts by weight of the silicone resin particles for use in the coating liquid for the charge transport layer in Example 1 were replaced by 0.005 parts by weight of a dimethyl silicone oil with a viscosity of 300 cSt (trademark "KF-96" made by Shin-Etsu Chemical Co., Ltd.) Thus, a photoconductor No. 5 was fabricated. In this case, the friction coefficient of the surface portion of the photoconductor No. 5 was 0.26.

Using the photoconductor No. 5 thus fabricated and the two-component developer (B) prepared in Example 2, toner images were evaluated in the same manner as in Example 1.

The results are shown in TABLE 1.

EXAMPLE 5

The procedure for fabrication of the photoconductor No. 1 in Example 1 was repeated except that 6 parts by weight of the silicone resin particles for use in the coating liquid for the charge transport layer in Example 1 were replaced by 0.005 parts by weight of a polyether-modified silicone oil with a viscosity of 180 cSt (trademark "TSF4440", made by Toshiba Silicone Co., Ltd.) Thus, a photoconductor No. 6 was fabricated. In this case, the friction coefficient of the surface portion of the photoconductor No. 6 was 0.29.

Using the photoconductor No. 6 thus fabricated and the two-component developer (B) prepared in Example 2, toner images were evaluated in the same manner as in Example 1.

The results are shown in TABLE 1.

EXAMPLE 6

The procedure for fabrication of the photoconductor No. 5 in Example 4 was repeated except that the viscosity of the dimethyl silicone oil for use in the coating liquid for the charge transport layer in Example 4 was changed from 300 to 100 cSt. Thus, a photoconductor No. 7 was fabricated. In this case, the friction coefficient of the surface portion of the photoconductor No. 7 was 0.25.

Using the photoconductor No. 7 thus fabricated and the two-component developer (B) prepared in Example 2, toner images were evaluated in the same manner as in Example 1.

The results are shown in TABLE 1.

EXAMPLE 7

The procedure for fabrication of the photoconductor No. 5 in Example 4 was repeated except that the dimethyl silicone oil for use in the coating liquid for the charge transport layer in Example 4 was replaced by an alcohol-modified silicone oil with a viscosity of 80 cSt (trademark "KF-851", made by Shin-Etsu Chemical Co., Ltd.) Thus, a photoconductor No. 8 was fabricated. In this case, the friction coefficient of the surface portion of the photoconductor No. 8 was 0.29.

Using the photoconductor No. 8 thus fabricated and the two-component developer (B) prepared in Example 2, toner images were evaluated in the same manner as in Example 1.

The results are shown in TABLE 1.

EXAMPLE 8

The procedure for fabrication of the photoconductor No. 8 in Example 7 was repeated except that the amount of the alcohol-modified silicone oil for use in the coating liquid for the charge transport layer in Example 7 was changed from 0.005 to 0.1 parts by weight. Thus, a photoconductor No. 9 was fabricated. In this case, the friction coefficient of the surface portion of the photoconductor No. 9 was 0.12.

Using the photoconductor No. 9 thus fabricated and the two-component developer (B) prepared in Example 2, toner images were evaluated in the same manner as in Example 1.

The results are shown in TABLE 1.

COMPARATIVE EXAMPLE 5

The procedure for fabrication of the photoconductor No. 8 in Example 7 was repeated except that the amount of the alcohol-modified silicone oil for use in the coating liquid for the charge transport layer in Example 7 was changed from 0.005 to 0.001 parts by weight. Thus, a photoconductor No. 10 was fabricated. In this case, the friction coefficient of the surface portion of the photoconductor No. 10 was 0.38.

Using the photoconductor No. 10 thus fabricated and the two-component developer (B) prepared in Example 2, toner images were evaluated in the same manner as in Example 1.

The results are shown in TABLE 1.

TABLE 1

| | Friction Coefficient of Photo-conductor | Average Circularity of Toner | Particles with Circularity of 0.90 or less (% by Number) | Rank of Occurrence of Non-image transferred spots |
|---|---|---|---|---|
| Ex. 1 | 0.40 | 0.943 | 8.12 | 4 |
| Comp. Ex. 1 | 0.54 | 0.943 | 8.12 | 2 |
| Ex. 2 | 0.40 | 0.955 | 5.14 | 4 |
| Ex. 3 | 0.10 | 0.948 | 7.87 | 5 |

TABLE 1-continued

| | Friction Coefficient of Photo-conductor | Average Circularity of Toner | Particles with Circularity of 0.90 or less (% by Number) | Rank of Occurrence of Non-image transferred spots |
|---|---|---|---|---|
| Comp. Ex. 2 | 0.46 | 0.955 | 5.14 | 3 |
| Comp. Ex. 3 | 0.40 | 0.928 | 22.53 | 2 |
| Comp. Ex. 4 | 0.54 | 0.928 | 22.53 | 1 |
| Ex. 4 | 0.26 | 0.955 | 5.14 | 4 |
| Ex. 5 | 0.29 | 0.955 | 5.14 | 4 |
| Ex. 6 | 0.25 | 0.955 | 5.14 | 4 |
| Ex. 7 | 0.29 | 0.955 | 5.14 | 4 |
| Ex. 8 | 0.12 | 0.955 | 5.14 | 5 |
| Comp. Ex. 5 | 0.38 | 0.955 | 5.14 | 3 |

As can be seen from the results shown in TABLE 1, the image formation method of the present invention can produce high quality images with high preciseness without non-image transferred spots.

Japanese Patent Application No. 2000-216526 filed Jul. 17, 2000 is hereby incorporated by reference.

What is claimed is:

1. An image formation method comprising the steps of charging the surface of an electrophotographic photoconductor, exposing said charged photoconductor to a light image to form a latent electrostatic image on said photoconductor, developing said latent electrostatic image using a two-component developer comprising a toner and a carrier to obtain a toner image, and transferring said toner image to an image receiving material directly or via an intermediate transfer member;

said photoconductor showing a surface friction coefficient of 0.40 or less, and said toner comprising toner particles with an average circularity of 0.930 or more, wherein said toner particles include toner particles with a circularity of 0.90 or less with a content ratio of 20% or less by number, wherein an outermost layer of the photoconductor includes silicone resin particles, wherein said photoconductor comprises a surface portion comprising a silicone oil, and wherein said silicone oil has a viscosity of 100 cSt or less.

2. The image formation method as claimed in claim 1, wherein said photoconductor has a surface friction coefficient of 0.29 or less.

3. The image formation method as claimed in claim 1, wherein said intermediate transfer member is situated in contact with said photoconductor and a transfer bias voltage is applied to said intermediate transfer member.

* * * * *